US006986334B2

(12) United States Patent
Lee

(10) Patent No.: US 6,986,334 B2
(45) Date of Patent: Jan. 17, 2006

(54) APPARATUS AND METHOD FOR START-DELAY WARNING OF AN LPI ENGINE

(75) Inventor: Woo Jik Lee, Suwon (KR)

(73) Assignee: Hyundai Motor Company, Seoul (KR)

( * ) Notice: Subject to any disclaimer, the term of this patent is extended or adjusted under 35 U.S.C. 154(b) by 38 days.

(21) Appl. No.: 10/705,602

(22) Filed: Nov. 10, 2003

(65) Prior Publication Data

US 2004/0099249 A1 May 27, 2004

(30) Foreign Application Priority Data

Nov. 8, 2002 (KR) ..... 10-2002-0068986

(51) Int. Cl.
*F02B 77/00* (2006.01)

(52) U.S. Cl. ..... 123/198 D; 123/198 R

(58) Field of Classification Search ..... 123/198 D, 123/198 R, DIG. 4, DIG. 12
See application file for complete search history.

(56) References Cited

U.S. PATENT DOCUMENTS

| | | | | |
|---|---|---|---|---|
| 4,361,121 | A * | 11/1982 | Clemens et al. | 123/198 DB |
| 4,763,621 | A * | 8/1988 | Stevens | 123/198 D |
| 4,899,706 | A * | 2/1990 | Sasaki | 123/198 D |
| 5,103,783 | A * | 4/1992 | Hanson et al. | 123/198 D |
| 6,640,770 | B2 * | 11/2003 | Woody | 123/198 D |

FOREIGN PATENT DOCUMENTS

JP 2002-222081 7/2002

* cited by examiner

*Primary Examiner*—Henry C. Yuen
*Assistant Examiner*—Jason Benton
(74) *Attorney, Agent, or Firm*—Morgan Lewis & Bockius LLP

(57) ABSTRACT

A method and apparatus for start delay warning in a liquefied petroleum gas injection engine is disclosed. During a period required for forming a sufficient fuel pressure in a fuel supply line, a warning signal is generated such that a driver is directed to maintain an ignition switch at its second (simply IG on) stage.

14 Claims, 2 Drawing Sheets

APPARATUS AND METHOD FOR START-DELAY WARNING OF AN LPI ENGINE

CROSS-REFERENCE TO RELATED APPLICATIONS

This application claims priority of Korean Application No. 10-2002-0068986, filed on Nov. 8, 2002, the disclosure of which is incorporated fully herein by reference.

1. Field of the Invention

Generally, the present invention relates to an LPI engine. More particularly, the present invention relates to an apparatus and method for start-delay warning for an LPI engine.

2. Background of the Invention

A conventional LPG (liquefied petroleum gas) engine uses only vapor pressure of LPG to run the engine. An LPI (liquefied petroleum gas injection) engine is different from an LPG engine in that it uses injectors that are supplied with the LPG from a fuel pump in an LPG fuel tank and injects the LPG in a liquid state.

When LPG is evaporated, its vapor pressure increases parabolically with respect to its temperature. In addition, when engine compartment temperature increases, a temperature of a fuel supply line thereon also accordingly increases.

When the engine is stopped after being driven at a high speed and a high load, heat radiation from the engine also acts on the fuel supply line at the engine, which causes an increase in the temperature of fuel that is stationary in the fuel supply line. Therefore, when the engine is turned off while it is hot, fuel in the fuel supply line is easily evaporated and its pressure becomes higher than an operating pressure of a pressure regulator. In this case, the fuel will return to a fuel tank through the pressure regulator. This means that the fuel in the fuel supply line becomes a mixture of gas and liquid.

A pressure regulator bypass valve is frequently included in the fuel supply system of an LPI engine, e.g., to prevent excessive production of hydro-carbons due to leakage of fuel in an injector. Such a pressure regulator bypass valve usually remains open while the engine is turned off. In this case, more fuel returns to the fuel tank, so the fuel supply line becomes short of fuel.

When LPG is evaporated, its volume becomes about 250 times that of when it is a liquid. Therefore, when the LPG fuel is injected while part of it is evaporated, the air-fuel mixture in a cylinder becomes very lean. Such a case may cause deterioration of stability of the LPI engine, e.g., causing its starting period to become longer or causing an engine stall phenomenon in which an almost started engine stalls.

In addition, a sufficient fuel pressure should be formed by a fuel pump for stable running of the engine. However, when the engine is started before such a sufficient fuel pressure is formed, fuel injection, which implies usage of fuel in the fuel supply line, negatively influences formation of such a sufficient fuel pressure for a certain period of time.

By modeling fuel composition, a current state of fuel in the fuel supply line can be estimated whether it remains a liquid state, a gas state, or a mixture state thereof, on the basis of a fuel temperature of the fuel supply line. In this case, by injecting fuel only after confirming that the fuel is in a liquid state, startability of the LPI engine may be enhanced especially when the engine is started while it is hot or partially cooled.

An LPI engine inevitably leaks fuel from its fuel supply line back to the fuel tank while the engine is turned off.

Therefore, when an ignition switch of the engine is turned on, the engine is required to have a so-called starting dead time during which fuel is supplemented in the fuel supply line before the engine is started.

During cold starting of an LPI engine, such as after sitting overnight so the temperature of the fuel supply line is similar to that of the fuel tank, vapor pressure of fuel in the fuel supply line is not high and therefore the amount of fuel required to be complemented is minor.

However, when the LPI engine is started while it is hot or partially cooled, in which case a large temperature difference exists between the fuel supply line and the fuel tank, the fuel pressure in the fuel supply line should be raised higher to a vapor pressure according to the temperature difference. Therefore, in this case, the starting dead time becomes longer, which may cause dissatisfaction of a driver.

Moreover, it should be noted that in such a cold start of the LPI engine, the fuel pump must be operated, which causes a consumption of approximately 10 A of electric power, in addition to operation of a start motor which also consumes a significant amount of electric power. The operation of both the fuel pump and the start motor may cause shortening of the life of the battery and a reduction of the efficiency of the fuel pump.

The information disclosed in this Background of the Invention section is only for enhancement of understanding of the background of the invention and should not be taken as an acknowledgement or any form of suggestion that this information forms the prior art that is already known to a person skilled in the art in this country.

SUMMARY OF THE INVENTION

Embodiments of the present invention provide an apparatus and method for start-delay warning of an LPI engine having non-limiting advantages of an enhanced stability of starting an LPI engine due to producing a warning signal depending on an operating state of the LPI engine.

An exemplary apparatus for start-delay warning of an LPI engine according to an embodiment of the present invention includes a drive state detection unit, an engine control unit, a fuel supply unit, and a warning unit. The drive state detection unit detects a drive state of the LPI engine, and includes an ignition switch. The engine control unit generates a fuel supply signal and a warning signal on the basis of signals from the drive state detection unit. The fuel supply unit is activated by the fuel supply signal from the engine control unit and supplies fuel to the LPI engine. The warning unit is activated by the warning signal from the engine control unit.

In a further embodiment, the drive state detection unit includes a temperature detector unit for detecting a fuel temperature of the fuel supply unit and a coolant temperature of the LPI engine, a pressure detector for detecting a fuel pressure of the fuel supply unit, and an engine speed detector for detecting a revolution speed of the LPI engine.

In a yet further embodiment, when the ignition switch is turned on to a second stage (simply IG ON), the engine control unit sends the warning signal to the warning unit and controls a fuel pump in the fuel supply unit to its maximum fluid output speed. In another further embodiment, the warning unit includes a warning lamp that either stays lit or blinks when activated. It is preferable that the engine control unit determines a target pressure on the basis of an injector temperature converted from the fuel temperature. It is further preferable that the engine control unit controls the fuel pump to its minimal speed and stops the sending of the warning signal to the warning unit when the LPI engine remains stopped and the fuel pressure of the fuel supply unit is greater than the target pressure.

In another preferred embodiment, the engine control unit stops sending of the warning signal to the warning unit when the LPI engine remains stopped and an activated period of the warning unit is greater than a predetermined period. It is preferable that the engine control unit sends the fuel supply signal to the fuel supply unit when the LPI Engine is undergoing starting and the fuel pressure of the fuel supply unit is greater than the target pressure. It is also preferable that the engine control unit controls the fuel pump to a normal operation and stops sending the warning signal to the warning unit when an engine speed of the LPI engine becomes greater than a predetermined threshold speed while the fuel supply signal is supplied to the fuel supply unit.

An exemplary method for start-delay warning of an LPI engine according to an embodiment of the present invention includes detecting a state of the LPI engine, maintaining a start-delay warning while the state of the LPI engine is inappropriate for starting, and stopping the start-delay warning when the state of the LPI engine becomes appropriate for starting.

It is preferable that the maintaining a start-delay warning includes generating a warning signal and controlling a fuel pump to its maximum flow rate output speed when an ignition switch is turned on, determining a target pressure on the basis of an injector temperature converted from a fuel temperature of a fuel supply unit, detecting a maintained period of the warning when a fuel pressure of the fuel supply unit is not greater than the target pressure, and maintaining the start-delay warning when the maintained period of warning is not greater than a predetermined maximal warning period. The stopping the warning preferably occurs when the fuel pressure becomes greater than the target pressure.

It is also preferable that an exemplary method for start-delay warning of an LPI engine further includes controlling the fuel pump to its minimal speed when the warning signal is stopped due to the fuel pressure becoming greater than the target pressure. The stopping the warning preferably occurs when the maintained period of warning is greater than the predetermined maximal warning period. It is preferable that the maintaining a start-delay warning includes starting fuel supply to the LPI engine when the fuel pressure of the fuel supply unit becomes greater than the target pressure, and maintaining the start-delay until an engine speed of the LPI engine becomes greater than a predetermined threshold speed after the starting of the fuel supply to the LPI engine. It is further preferable that the stopping the warning occurs when the engine speed becomes greater than the predetermined threshold speed.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

A preferred embodiment of the present invention will hereinafter be described in detail with reference to the accompanying drawings.

Figure 1:
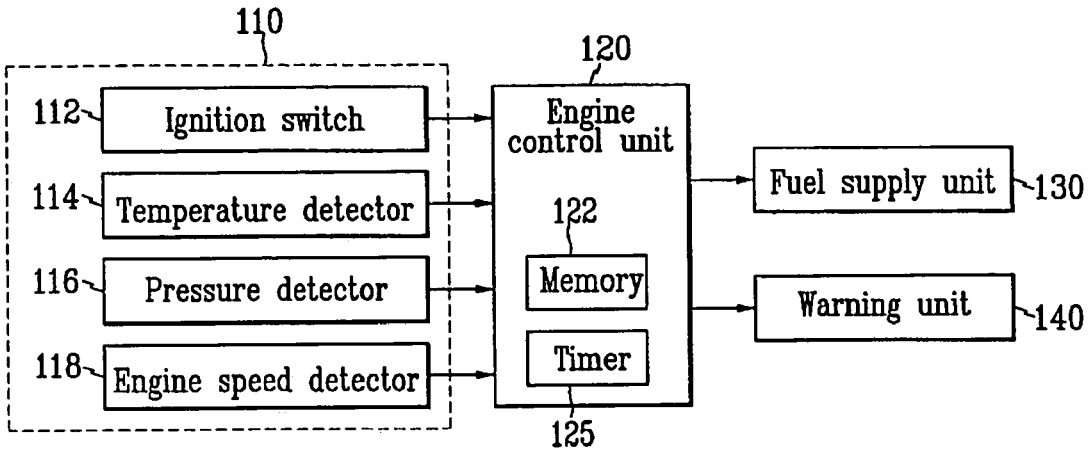
FIG. 1 is a block diagram of an apparatus for start-delay warning of an LPI engine according to an embodiment of the present invention.

As shown in FIG. 1, an apparatus for start-delay warning of an LPI engine according to an embodiment of the present invention includes a drive state detection unit 110, an engine control unit (ECU) 120, a fuel supply unit 130, and a warning unit 140.

The drive state detection unit 110 includes an ignition switch 112, a temperature detector unit 114, a pressure detector 116, and an engine speed detector 118.

The temperature detector unit 114 detects a fuel temperature in the fuel supply line of the fuel supply unit 130 and a coolant temperature for the LPI engine. The pressure detector 116 detects a fuel pressure of the fuel supply line of the fuel supply unit 130. The engine speed detector 118 detects a revolution speed of the LPI engine.

The ignition switch 112 has a plurality of switching stages which can be detected by the ECU 120. The switching stages includes a first stage ACC for driving simple electric devices such as a radio; a second stage IG-ON for supplying electric power to electric devices for keeping the engine running; and a third stage ST for activating a start motor for starting the LPI engine.

The ECU 120 can be realized by one or more processors activated by a predetermined program, and the predetermined program can be programmed by a person of ordinary skill in the art to perform each step of a method according to a preferred embodiment of this invention based on the teachings herein contained.

For example, when the ignition switch 112 is turned to the second stage, the ECU 120 sends the warning signal to the warning unit, and at the same time, controls the fuel pump in the fuel supply unit 130 to its maximum flow rate output speed. In addition, the ECU 120 determines a target pressure P1 on the basis of an injector temperature converted from the fuel temperature of the fuel supply line.

The injector temperature is predetermined as a function of the fuel temperature of the fuel supply line and the coolant temperature, of which detailed values may be obtained obviously through experiments by a person of ordinary skill in the art.

Under the target pressure P1 being determined, the ECU 120 determines whether the engine remains stopped on the basis of signals from the engine speed detector 118.

When the engine remains stopped, the ECU 120 determines whether the fuel pressure P2 detected by the pressure detector 116 is greater than the target pressure P1.

When the detected fuel pressure P2 is greater than the target pressure P1, the ECU 120 stops sending the warning signal to the warning unit 140, and controls the fuel pump to its minimal speed. To the contrary, when the detected fuel pressure P2 is not greater than the target pressure P1, the ECU 120 detects an activated period T2 of the warning unit 140, and after comparing the activated period T2 with a predetermined period T1, stops sending the warning signal to the warning unit 140 if the activated period T2 of the warning unit 140 is greater than the predetermined period T1.

When starting of the engine has already begun, the ECU 120 also determines whether the fuel pressure P2 detected by the pressure detector 116 is greater than the target pressure P1.

The ECU 120 then sends a fuel supply signal to the fuel supply unit 130 when the detected fuel pressure P2 is greater than the target pressure P1.

While the fuel supply signal is being sent to the fuel supply unit 130, the ECU 120 stops sending of the warning signal to the warning unit 140 and controls the fuel pump to its normal operation speed when the engine speed obtained by the engine speed detector 118 is greater than a predetermined threshold speed. The threshold speed is a speed above which the engine becomes stably started and can be set by a person of ordinary skill in the art depending on the engine.

The fuel supply unit 130 supplies fuel to the LPI engine according to the fuel supply signal from the ECU 120. The warning unit 140 recognizes the warning signal received from the ECU 120 so that a driver can be directed to maintain the ignition switch 112 at its second stage during the starting dead time. The warning unit 140 may be installed in an instrument panel, and includes a warning lamp that either stays lit or blinks when activated.

Figure 2:
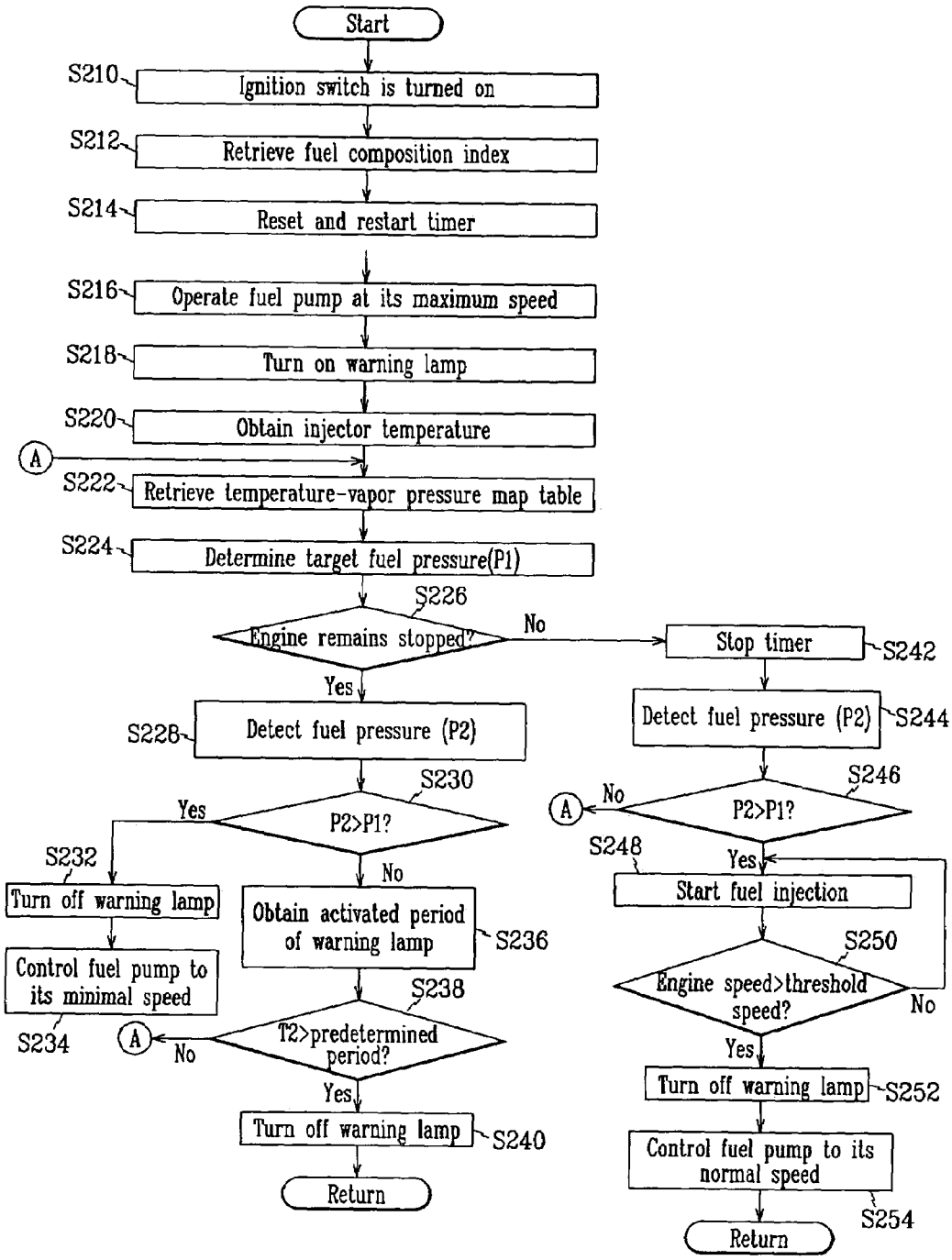
FIG. 2 is a flowchart showing a method for start-delay warning of an LPI engine according to a preferred embodiment of the present invention.

A method for start-delay warning of the LPI engine according to an embodiment of the present invention is hereinafter described with reference to FIGS. 1 and 2.

A method for start-delay warning of the LPI engine according to an embodiment of the present invention includes detecting a state of the LPI engine based on signals from the drive state detection unit 110, maintaining a start-delay warning while the state of the LPI engine is inappropriate for starting, and stopping the start-delay warning when the state of the LPI engine becomes appropriate for starting. As shown in FIG. 2, at step S210, the ECU 120 firstly detects the second stage IG-ON of the ignition switch 110 when the switch 110 is turned thereto.

Subsequently, at step S212, the ECU 120 accesses (or retrieves) a fuel composition index stored in a non-volatile memory 122. The fuel composition index is stored as a predetermined value, e.g., as a butane ratio of the LPG fuel. At step S214, the ECU 120 resets a timer 125 and restarts it.

Next, at step S216, the ECU 120 controls the fuel pump to its maximum flow rate output speed RPMMAX directly. That is to say, when the ignition switch 112 is turned to the second stage, it is preferable that the fuel pump is controlled to its maximum speed such that an increase of the fuel pressure of the fuel supply line is accelerated. However, in order to prevent unnecessary discomfort because of the operating noise of the fuel pump, the maximal duration is set within about 2–3 seconds.

At step S218, the ECU 120 activates the warning unit 140 such that the warning unit 140 receives the warning signal, warning to maintain the second stage of the ignition switch 112 and not to start the engine (i.e., not to turn the ignition switch 112 to the third stage).

Subsequently, at step S220, the ECU 120 converts the fuel temperature of the fuel supply line to an injector temperature as a function of fuel and coolant temperature, and then at step S222, the ECU 120 retrieves a temperature-vapor pressure map table stored in the memory 122.

Then in step S224, the ECU 120 determines the target pressure P1 on the basis of the fuel composition index, the fuel temperature of the fuel supply line, and the map table.

In more detail, at step S224, the ECU 120 determines the target pressure P1 based on the injector temperature obtained at the step S220 as the fuel temperature. This is because the fuel temperature inside an injector is higher than the fuel temperature in a fuel supply line when an LPI engine is hot or only partially cooled.

The map table includes pre-calculated values of a saturated vapor pressure with respect to the fuel composition index and the fuel temperature, detailed values of which can be obviously set through the characteristic table which has already been published.

When the target pressure P1 is determined, the ECU 120 determines whether the LPI engine remains stopped at step S226. Whether the LPI engine remains stopped may be determined on the basis of signals from the engine speed detector 118.

When the engine remains stopped at the step S226, the ECU 120 receives the fuel pressure P2 from the pressure detector 116 at step S228, and determines whether the detected fuel pressure P2 is greater than the target pressure P1 at step S230.

When the detected fuel pressure P2 is greater than the target pressure P1, the ECU 120 stops sending of the warning signal to the warning unit 140 at step S232, and controls the fuel pump to its minimal speed at step S234.

When the detected fuel pressure P2 is not greater than the target pressure P1, the ECU 120 retrieves an activated period T2 of the warning unit 140 from the timer 125 at step S236, and At step S238, the ECU 120 determines whether the activated period T2 of the warning unit 140 is greater than a predetermined period T1.

When the activated period T2 of the warning unit 140 is greater than the predetermined period T1, the ECU 120 stops sending of the warning signal to the warning unit 140 at step S240. The step S240 is useful for a case in which an operation of the warning unit 140 is abnormally continuing, so a driver may feel bored to be waiting. That is, by the step S240, the activated period of the warning unit 140 has a time limit.

When the activated period T2 of the warning unit 140 is not greater than the predetermined period T1, the ECU 120returns to the step S222, so the warning signal continues being realized by the warning unit 140.

Referring back to step S226, when the engine is starting (i.e., the ignition switch is turned to the third stage), the ECU 120 stops the timer at step S242. The ECU then detects the fuel pressure P2 with the pressure detector 116 at step S244, and determines whether the detected fuel pressure P2 is greater than the target pressure P1 at step S246.

When the detected fuel pressure P2 is greater than the target pressure P1, the ECU 120 starts fuel injection by sending the fuel supply signal to the fuel supply unit 130 at step S248. The amount of fuel injected by the injector according to the fuel supply signal is a value obtained by multiplying a pressure compensation rate by a base fuel amount T1 depending on driving conditions of the engine.

While the fuel supply signal is being sent to the fuel supply unit 130, the ECU 120 determines at step S250 whether the engine speed obtained by the engine speed detector 118 is greater than a predetermined threshold speed.

When the engine speed is greater than the predetermined threshold speed, the ECU 120 stops the sending of the warning signal to the warning unit 140 at step S252, and then the ECU 120 controls the fuel pump to its normal operation speed at step S254.

When the engine speed is not greater than the predetermined threshold speed, the ECU 120 returns to the step S248 while maintaining the sending of the warning signal to the warning unit 140.

As described above, according to an embodiment of the present invention, startability of an LPI engine and a life period of a battery may be enhanced by controlling a warning unit so that a driver can be guided to maintain an ignition switch at its second stage during a period required to form sufficient fuel pressure in a fuel supply line While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. An apparatus for start-delay warning of an LPI engine, comprising:

a drive state detection unit for detecting a drive state of the LPI engine, the drive state detection unit comprising an ignition switch;

an engine control unit for generating a fuel supply signal and a warning signal on the basis of signals from the drive state detection unit;

a fuel supply unit, being activated by the fuel supply signal from the engine control unit, for supplying fuel to the LPI engine; and a warning unit activated by the warning signal from the engine control unit, wherein, when the ignition switch is turned on to a second stage, the engine control unit sends the warning signal to the warning unit and controls a fuel pump in the fuel supply unit to its maximum flow rate output speed.

2. The apparatus of claim 1, wherein the drive state detection unit further comprises:

a temperature detector unit for detecting a fuel temperature of the fuel supply unit and a coolant temperature of the LPI engine;

a pressure detector for detecting a fuel pressure of the fuel supply unit; and an engine speed detector for detecting a revolution speed of the LPI engine.

3. The apparatus of claim 1, wherein the warning unit comprises a warning lamp that either stays lit or blinks when activated.

4. The apparatus of claim 2, wherein the engine control unit determines a target pressure on the basis of an injector temperature converted from the fuel temperature and coolant temperature.

5. The apparatus of claim 4, wherein the engine control unit controls the fuel pump to its minimal speed and stops sending of the warning signal to the warning unit when the LPI engine remains stopped and the fuel pressure of the fuel supply unit is greater than the target pressure.

6. The apparatus of claim 5, wherein the engine control unit stops sending of the warning signal to the warning unit when the LPI engine remains stopped and an activated period of the warning unit is greater than a predetermined period.

7. The apparatus of claim 4, wherein the engine control unit sends the fuel supply signal to the fuel supply unit when the LPI is undergoing starting and the fuel pressure of the fuel supply unit is greater than the target pressure.

8. The apparatus of claim 7, wherein the engine control unit controls the fuel pump to a normal operation and stops sending the warning signal to the warning unit when an engine speed of the LPI engine becomes greater than a predetermined threshold speed while the fuel supply signal is supplied to the fuel supply unit.

9. A method for start-delay warning of an LPI engine comprising:

detecting a state of the LPI engine;

maintaining a start-delay warning while the state of the LPI engine is inappropriate for starting; and stooping the start-delay warning when the state of the LPI engine becomes appropriate for starting, wherein the maintaining a start-delay warning comprises generating a warning signal and controlling a fuel pump to its maximum flow rate output speed when an ignition switch is turned on;

determining a target pressure on the basis of an injector temperature converted from a fuel temperature of a fuel supply unit and coolant temperature;

detecting a maintained period of the warning when a fuel pressure of the fuel supply unit is not greater than the target pressure; and maintaining the start-delay warning when the maintained period of warning is not greater than a predetermined period.

10. The method of claim 9, wherein the stopping the start-delay warning occurs when the fuel pressure becomes greater than the target pressure.

11. The method of claim 10, further comprising controlling the fuel pump to its minimal speed when the warning signal is stopped due to the fuel pressure becoming greater than the target pressure.

12. The method of claim 9, wherein the stopping the start-delay warning occurs when the maintained period of warning is greater than the predetermined period.

13. The method of claim 9, wherein the maintaining the start-delay warning comprises:

starting a fuel supply to the LPI engine when the fuel pressure of the fuel supply unit becomes greater than the target pressure; and maintaining the start-delay warning until an engine speed of the LPI engine becomes greater than a predetermined threshold speed after the starting of the fuel supply to the LPI engine.

14. The method of claim 13, wherein the stopping the start-delay warning occurs when the engine speed becomes greater than the predetermined threshold speed.

* * * * *